United States Patent [19]

Houston

[11] Patent Number: 5,076,577

[45] Date of Patent: Dec. 31, 1991

[54] COUPLING FOR ATTACHMENTS TO AN EXERCISE APPARATUS

[75] Inventor: Stephen R. Houston, Gaithersburg, Md.

[73] Assignee: Magnaflex Associates Limited, Gaithersburg, Md.

[21] Appl. No.: 513,519

[22] Filed: Apr. 20, 1990

Related U.S. Application Data

[63] Continuation-in-part of Ser. No. 270,449, Nov. 7, 1988, Pat. No. 4,919,419, which is a continuation-in-part of Ser. No. 88,425, Aug. 24, 1987, abandoned.

[51] Int. Cl.[5] ..... A63B 21/00

[52] U.S. Cl. ..... 272/134; 272/123; 272/144; 403/109; 403/379

[58] Field of Search ..... 272/117, 118, 123, 134, 272/144; 403/108, 109, 354, 378, 379

[56] References Cited

U.S. PATENT DOCUMENTS

| | | | |
|---|---|---|---|
| 3,280,439 | 10/1966 | McCarthy | 403/354 X |
| 3,345,711 | 10/1967 | McCarthy | 403/379 X |
| 3,515,418 | 6/1970 | Nielsen, Jr. . | |
| 3,719,378 | 3/1973 | Windsor | 403/284 X |
| 4,140,298 | 2/1979 | Colemen, Jr. . | |
| 4,286,782 | 9/1981 | Fuhrho | 272/117 |
| 4,369,966 | 1/1983 | Silberman et al. | 272/123 X |
| 4,407,495 | 10/1983 | Wilson | 272/117 |
| 4,549,733 | 10/1985 | Salyer et al. | 272/118 |
| 4,637,608 | 1/1987 | Owens et al. | 272/134 |
| 4,744,560 | 5/1988 | Azari | 272/118 |
| 4,784,384 | 11/1988 | Deola | 272/118 |
| 4,887,929 | 12/1989 | Hale | 403/354 X |

*Primary Examiner*—Robert Bahr
*Attorney, Agent, or Firm*—Joseph P. Nigon

[57] ABSTRACT

The device is for coupling, attachments or accessories to a bench-type exercising apparatus for use in performing arm and leg exercises. The attachments are movable and have multi-positionable body engagement elements. The coupling attachments consist of a rectangular tubular support for the attachment dimensioned to fit into the rectangular tubular support for supporting the bench, having a forwardly extending C-shaped slot dimension to fit about a pin passing through an aperture in the bench support and a movable pin passing through aligned apertures in the bench support and the tubular support.

1 Claim, 1 Drawing Sheet

COUPLING FOR ATTACHMENTS TO AN EXERCISE APPARATUS

This application is a continuation in part of application Ser. No. 270,449 filed Nov. 7, 1988, now U.S. Pat. No. 4,919,419 which is in turn a continuation in part of application Ser. No. 88,425 filed Aug. 24, 1987, now abandoned.

BACKGROUND OF THE INVENTION

The present invention relates to body exercising devices, more particularity to coupling for attachment of accessories to a bench type exercise apparatus for use in performing arm and leg exercises. The attachments are movable and have multi-positionable body engagement elements. The attachments are coupled to the bench type exercising apparatus.

DESCRIPTION OF THE PRIOR ART

There are several patents disclosing exercising devices and equipment. U.S. Pat. No. 4,369,966 discloses a folding exercise apparatus for developing and conditioning various parts of the body. U.S. Pat. No. 4,407,495 and U.S. Pat. No. 4,286,782 disclose multipurpose exercising devices. U.S. Pat. No. 4,549,733 relates to a weight type exercising device. Typical of the art relating to coupling devices are U.S. Pat. No. 3,515,418 relating to a locking mechanism and telescoping assembly and U.S. Pat. No. 4,140,298 describing a post and rail fence construction.

SUMMARY OF THE INVENTION

It is an object of the present invention to provide a coupling assembly for connecting attachments to a bench type exercising device.

It is another object of the invention to provide a coupling device to connect attachments such as leg and curl attachments, preacher curl attachments and other similar attachments to a bench type exercising device.

Another object of the present invention is to provide a greatly improved coupling for connecting attachments to a bench type exercise device. The coupling holds the attachments firmly in place. The attachments can be coupled and detached from the exercise device quickly and with a minimum of effort.

DETAILED DESCRIPTION OF THE INVENTION

The instant invention relates specifically to means for coupling attachments to my Exercise Apparatus described in U.S. Pat. No. 4,919,419, incorporated herein by reference.

It is in common constructing exercise apparatus to fabricate several of the elements of these devices from steel having a rectangular tubular configuration. The instant invention describes and claims a means for coupling the attachments into some of the square tubular elements of the exercise device, in a manner such that the attachment is held firmly in place and can be readily removed from the apparatus.

DESCRIPTION OF THE INVENTION

Figure 1:
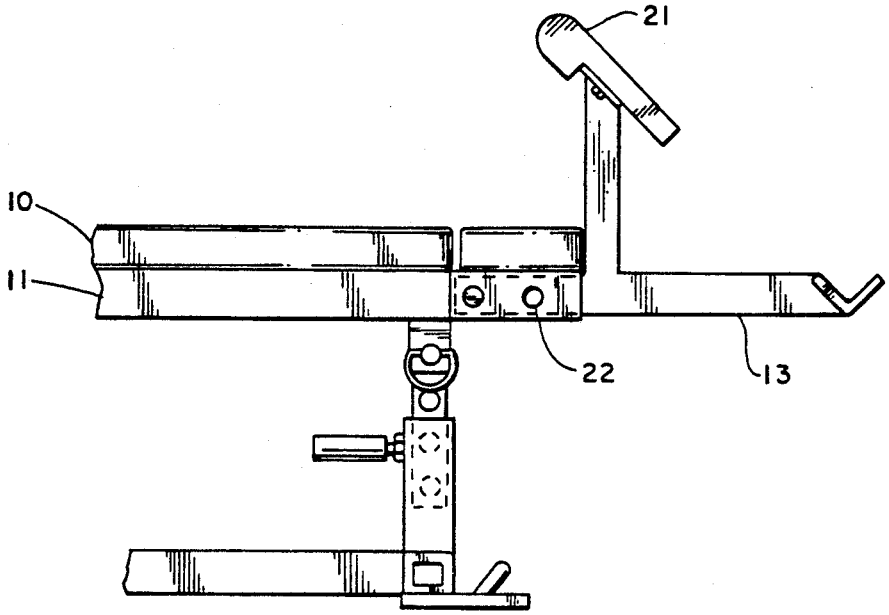
FIG. 1 is a fragmentary side elevation view showing the bench with one of the attachments in place.

Referring now to FIG. 1, the bench pad 10 is positioned above a square tubular support member 11 with the attachment 21 coupled to the support member 11.

Figure 2:
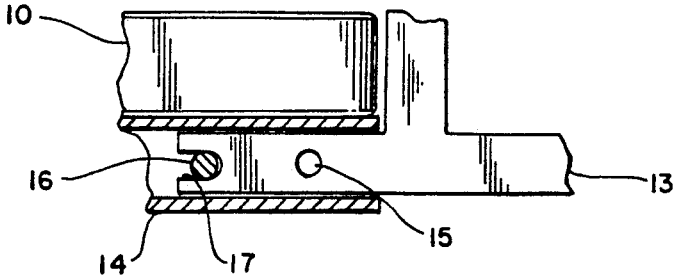
FIG. 2 is a fragmentary section view of a portion of the structure shown in FIG. 1.

Referring now to FIG. 2, a fragmentary sectional enlarged view of a portion of the bench support member 11 and the bench pad 10 showing the method of coupling the attachments to the bench support 11. The male tube attachment 13 is positioned in a portion of the bench support 11, here labeled as the female tube 14. The essential features of this system include the C shaped slot 17 in the male tube 13 that fits over the bolt 16 and is held firmly in place by the pin 15 that passes through the apertures 18 in the female tube 14 and the apertures 22 in the bench support tube 11.

Figure 3:
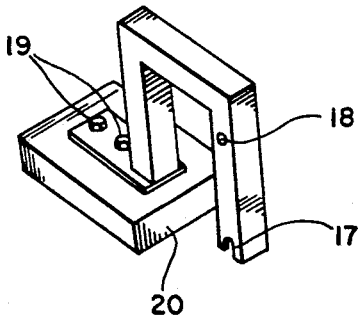
FIG. 3 is a bottom perspective view of a preacher attachment.

Referring now to FIG. 3 which shows an attachment 20 with the C shaped slot 17 and the aperture 18 for receiving any suitable pin member. The top of the member 20 is attached by bolts 19.

Figure 4:
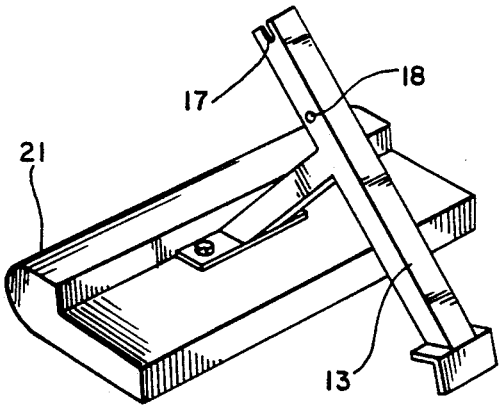
FIG. 4 is bottom perspective view of the preacher attachment shown connected to the bench in FIG. 1.

Referring now to FIG. 4 which shows the attachment 21, shown attached to the bench in FIG. 1, with the C shaped slot 17 on the forward end of the female tube 13 and the aperture 18 for receiving any suitable pin.

Obviously many modifications and variations of the invention may be made without departing from the essence and scope thereof. Only such limitations should be applied as are indicated in the appended claims.

What is claimed is:

1. In an exercise apparatus consisting essentially of a horizontal stand adapted to abut on a floor, first and second tubular uprights supporting a rectangular tubular means for supporting an adjustable bench, the improvement comprising means for coupling attachments to the horizontal tubular bench support means, consisting of a rectangular tubular support for said attachment, said support dimensioned to telescope into the rectangular tubular means for supporting said bench, the forward end of said rectangular tubular support having a forwardly extending C shaped slot dimensioned to fit about a pin passing through an aperture in said bench support means, and a removable pin passing through aligned apertures in said bench support means and said tubular support for said attachment to hold said attachment firmly in place.

* * * * *